US009199709B2

(12) United States Patent
De Turckheim

(10) Patent No.: US 9,199,709 B2
(45) Date of Patent: Dec. 1, 2015

(54) FRAME DEVICE FOR A PROFILED SAIL DEVICE, AND PROFILED SAIL DEVICE COMPRISING AT LEAST ONE FRAME DEVICE

(75) Inventor: Hugues De Turckheim, La Seyne sur mer (FR)

(73) Assignee: SoftWing SA, Lausanne (CH)

( * ) Notice: Subject to any disclaimer, the term of this patent is extended or adjusted under 35 U.S.C. 154(b) by 60 days.

(21) Appl. No.: 14/124,140

(22) PCT Filed: May 16, 2012

(86) PCT No.: PCT/EP2012/059176

§ 371 (c)(1),
(2), (4) Date: Feb. 25, 2014

(87) PCT Pub. No.: WO2012/168048

PCT Pub. Date: Dec. 13, 2012

(65) Prior Publication Data

US 2014/0224161 A1 Aug. 14, 2014

(30) Foreign Application Priority Data

Jun. 8, 2011 (EP) ..... 11169042

(51) Int. Cl.
*B63H 9/06* (2006.01)

(52) U.S. Cl.
CPC ..... *B63H 9/0607* (2013.01); *B63H 2009/0635* (2013.01)

(58) Field of Classification Search
CPC ..... B63H 9/00; B63H 9/06; B63H 9/0607; B63H 9/04
USPC ..... 114/102.22, 102.26, 39.31
See application file for complete search history.

(56) References Cited

U.S. PATENT DOCUMENTS

| | | | |
|---|---|---|---|
| 2,650,047 | A | 8/1953 | Carhart et al. |
| 4,624,203 | A | 11/1986 | Ferguson |
| 5,603,276 | A | 2/1997 | Julien |

FOREIGN PATENT DOCUMENTS

| | | |
|---|---|---|
| DE | 4002972 | 8/1991 |
| DE | 4207539 | 9/1993 |
| EP | 0511050 | 10/1992 |
| EP | 0453713 | 12/1994 |
| WO | WO 03022672 | 3/2003 |
| WO | WO 2004024556 | 3/2004 |

*Primary Examiner* — Lars A Olson
(74) *Attorney, Agent, or Firm* — Davidson, Davidson & Kappel, LLC

(57) ABSTRACT

A frame device for a profiled sail device. At least one frame element has a first profile contour that corresponds to one sail surface and a second profile contour that corresponds to another sail surface. The frame device has a profile contour with at least one profile contour section which is formed by a profile contour of the frame element, and the frame device can be adjusted between a first operating position and a second operating position. In a first operating position the first profile contour forms a contour section for the first sail surface or for the second sail surface, and the second profile contour does not form a profile contour section; and in the second operating position, the first profile contour does not form a profile contour section of the frame device for the sail surface, and the second profile contour forms at least one profile contour section of the frame device for the respective other sail surface.

15 Claims, 6 Drawing Sheets

FRAME DEVICE FOR A PROFILED SAIL DEVICE, AND PROFILED SAIL DEVICE COMPRISING AT LEAST ONE FRAME DEVICE

The present invention relates to a frame device for a profiled sail device, the frame device having multiple frame elements which may be adjusted in relation to each other, at least one frame element having a first profile contour which is assigned to one sail surface and a second profile contour which is assigned to another sail surface, the frame device having a profile contour which has at least one profile contour section which is formed with the aid of a profile contour of the at least one frame element, and the frame device being adjustable between a first operating position and a second operating position, a profiled sail device having a first inflow sail surface which forms a first profile surface, a second inflow sail surface which forms a second profile surface, a sail leading edge and an adjustable skeleton device situated between the first sail surface and the second sail surface as well as a profiled sail device having a first inflow sail surface which forms a first profile surface, a second inflow sail surface which forms a second profile surface, and an adjustable skeleton device situated between the first sail surface and the second sail surface which forms a second profile surface, an adjustable skeleton device having multiple frame elements situated between the first sail surface and the second sail surface, at least one frame device having multiple frame elements which are adjustable in relation to each other and are each intrinsically rigid.

BACKGROUND

A device is known from EP 511 050 A1, which includes at least one aerodynamically shaped element, at least one part or one zone of which is able to fold up, for the purpose of propulsion and/or lift under the effect of the wind directed thereon, having two surfaces, one for the pressure (windward) side and one for the suction (leeward) side, in which at least one slit is provided to permit the flow of air from the pressure side to the suction side, and control elements are provided to conduct the air exiting the aforementioned slit on the suction side tangentially to the aforementioned element, in which the aforementioned slit and the aforementioned control elements of the aforementioned flow have an effect on the position and on the geometry of at least one part and/or one zone of the aforementioned element with regard to the geometry and the opening/closure with the aid of devices, and in which the aforementioned device furthermore includes means which control the geometry of the aforementioned element, at least the shape and depth of the concavity, for the purpose of providing an aerodynamic element having an adjustable geometry, which is equipped with means which improve the air flow from the pressure side to the suction side in such a way that the air on the suction side empties into a flow which flows in the same direction and on the same side as the flow of the suction-side outflow at the junction between the aforementioned flow and the aforementioned outflow, the element retaining its aerodynamic shape. (i.e., without shifting, without concavity, without an obstacle which forms a conducting element, among other things), even if no air through-flow arises (for example if the aerodynamic element is only slightly curved and if a principle is used which is valid for all elements of an aerodynamic shape for the thin as well as for the thick hydrofoils).

SUMMARY OF THE INVENTION

It is an object of the present invention to structurally and/or functionally improve an aforementioned frame device and to provide an aforementioned profiled sail device which is structurally and/or functionally improved. In particular, a frame device and/or a profiled sail device is/are provided, with the aid of which the means of adjusting a propulsion and a heel is improved and whose handling is improved.

The present invention provides a frame device for a profiled sail device, the frame device having multiple frame elements which are adjustable in relation to each other, at least one frame element having a first profile contour which is assigned to one sail surface, and a second profile contour which is assigned to another sail surface, the frame device having a profile contour which has at least one profile contour section which is formed with the aid of a profile contour of the at least one frame element, and the frame device being adjustable between a first operating position and a second operating position, in which, in the first operating position, the first profile contour of the at least one frame element forms at least one profile contour section of the frame device for the first sail surface or for the second sail surface, and the second profile contour of the at least one frame element does not form a profile contour section of the frame device for the sail surface and, in the second operating position, the first profile contour of the at least one frame element does not form a profile contour section of the frame device for the sail surface, and the second profile contour of the at least one frame element forms at least one profile contour section of the frame device for the other sail surface.

The frame device may be adjustable between a first end position and a second end position. The first end position may correspond to the first operating position. The second end position may correspond to the second operating position. Additional operating positions may be present between the first end position and the second end position. An inflow sail surface may be a sail surface against which wind may blow.

In the frame device according to the present invention, alternately according to the operating position, the first profile contour of the at least one frame device forms at least one profile contour section of the frame device for the first sail surface or for the second sail surface, and the second profile contour of the at least one frame element does not form a profile contour section of the frame device for the sail surface, or the first profile contour of the at least one frame element does not form a profile contour section of the frame element for the sail surface, and the second profile contour of the at least one frame element forms at least one profile contour section of the frame element for the other sail surface. A profile contour section of the frame device is not formed simultaneously by the at least approximately entire first profile contour and the at least approximately entire second profile contour of the at least one frame element. The at least one frame element and/or a skeleton device having a frame element of this type has/have a narrow width in relation to a distance between the first sail surface and the second sail surface. A width of the at least one frame element and/or a skeleton device having a frame element of this type is narrower than a distance between the first sail surface and the second sail surface. The frame device and/or the at least one frame element and/or a profiled sail having a frame device of this type take(s) up a smaller amount of installation space. The frame device and/or the at least one frame element and/or the profiled sail having a frame device of this type is/are improved with regard to lightweight construction aspects. The frame device and/or the at least one frame element and/or the profiled sail having a frame device of this type has/have a reduced weight. The frame device and/or the at least one frame element and/or the profiled sail having a frame device of this type has/have a higher rigidity and/or strength. The frame device and/or the at least one frame element and/or the profiled sail having a frame device of this type is/are easier to handle. A profiled sail device having a frame device of this type may be more easily hoisted and/or lowered. A profiled sail device having a frame device of this type may be more easily adjusted. A profiled sail device having a frame device of this type has improved sailing properties. A profiled sail device having a frame device of this type has improved hydrofoil properties. A profiled sail device having a frame device of this type has reduced space requirements in the folded-up state.

The frame device may have a first frame element, a second frame element and a third frame element, each of which may be adjustable in relation to each other, the second frame element being situatable between the first frame element and the third frame element, the first frame element being able to have a first profile contour which is assigned to the first sail surface, and a second profile contour which is assigned to the second sail surface, the second frame element being able to have a first profile contour which is assigned to the second sail surface and a second profile contour which is assigned to the first sail surface, the third frame element being able to have a first profile contour which is assigned to the first sail surface, and a second profile contour which is assigned to the second sail surface, in the first operating position, the first profile contour of the first frame element being able to form a profile contour section of the frame element for the first sail surface, and the second profile contour of the first frame element not being able to form a profile contour section of the frame device for the sail surface, the first profile contour of the second profile element being able to form a profile contour section of the frame device for the second sail surface, and the second profile contour of the second frame element not being able to form a profile contour section of the frame device for the sail surface, and the first profile contour of the third frame element being able to form a profile contour section of the frame device for the first sail surface, and the second profile contour of the third frame element not being able to form a profile contour section of the frame device for the sail surface, and in the second operating position, the first profile contour of the first frame element not being able to form a profile contour section of the frame device for the sail surface, and the second profile contour of the first frame element being able to form a profile contour section of the frame device for the second sail surface, the first profile contour of the second frame element being able to form a profile contour section of the frame device for the second sail surface, and the second profile contour of the second frame element not being able to form a profile contour section of the frame device for the sail surface, and the first profile contour of the third frame element not being able to form a profile contour section of the frame device for the sail surface, and the second profile contour of the third frame element being able to form a profile contour section of the frame device for the second sail surface.

The frame device may have a first frame element, a second frame element and a third frame element, each of which is adjustable in relation to each other, whereby the second frame element may be situated between the first frame element and the third frame element, the first frame element being able to have a first profile contour which is assigned to the first sail surface, and a second profile contour which is assigned to the second sail surface, the second frame element being able to have a first profile contour which is assigned to the first sail surface, and a second profile contour which is assigned to the second sail surface, the third frame element being able to have a profile contour which is assigned to a sail leading edge, in the first operating position, the first profile contour of the first frame element being able to form a profile contour section of the frame element for the first sail surface, and the second profile contour of the first frame element not being able to form a profile contour section of the frame device for the sail surface, one section of the second profile contour of the second frame element being able to form a profile contour section of the frame device for the second sail surface, and at least approximately the entire first profile contour of the second frame element being able to form a profile contour section of the frame device for the first sail surface, and the profile contour of the third frame element being able to form a profile contour section of the frame device assigned to the sail leading edge, and in the second operating position, the first profile contour of the first frame element being able to form a profile contour section of the frame device for the second sail surface, and the second profile contour of the first frame element not being able to form a profile contour section of the frame device for the sail surface, one section of the first profile contour of the second frame element being able to form a profile contour section of the frame device for the first sail surface, and at least approximately the entire the second profile contour of the second frame element being able to form a profile contour section of the frame device for the second sail surface, and the profile contour of the third frame element being able to form a profile contour section of the frame device assigned to the sail leading edge.

One frame element and another frame element may be adjustably connected to each other with the aid of a hinge-like joint. The one frame element may have a fork-like joint socket and the other frame element may have a tooth-like joint head. The joint may have a first stop for limiting an adjustability in the first operating position and a second stop for limiting an adjustability in the second operating position. The joint may have a first stop for limiting an adjustability in the first end position and a second stop for limiting an adjustability in the second end position.

At least two frame elements which are adjustable in relation to each other may be kinematically coupled in such a way that an adjustment of one frame element causes an adjustment of another frame element. One frame element may have a first coupling section having a gap for kinematic coupling with another frame element, and the other frame element may have a second coupling section having an extension. The first coupling section and the second coupling section may form a hinge-like joint. The first coupling section may have a fork-like joint socket. The second coupling section may have a tooth-like joint head.

The frame device may have a first frame element, a second frame element and a third frame element, each of which are adjustable in relation to each other, the second frame element being situatable between the first frame element and the third frame element, and the first frame element being kinematically coupleable with the third frame element in such a way that an adjustment of the first frame element or the third frame element causes an adjustment of the other frame element.

The object is also achieved by a profiled sail device having a first inflow sail surface which forms a first profile surface, a second inflow sail surface which forms a second profile surface, a sail leading edge and an adjustable skeleton device which is situated between the first sail surface and the second sail surface, in which the skeleton device has at least one frame device of this type.

The present invention also provides a profiled sail device having a first inflow sail surface which forms a first profile surface, a second inflow sail surface which forms a second profile surface and an adjustable skeleton device having multiple frame devices, which is situated between the first sail surface and the second sail surface, in which at least one frame device has multiple frame elements which are adjustable in relation to each other and are each intrinsically rigid, at least one frame device having multiple frame elements which are adjustable in relation to each other and are intrinsically rigid, in which at least one frame element has a first profile contour which abuts the first sail surface in the operating position and a second profile contour which abuts the second sail surface in the second operation position, and/or in which at least one frame element has a first profile contour which abuts the second sail surface in the first operating position and a second profile contour which abuts the first sail surface in the second operating position.

The profiled sail device may be connected to a mast. The profiled sail device may be used with a sailing craft. The sailing craft may be a water vehicle or a land vehicle. The sailing craft may be a sailboat, an ice sailboat or a land sailer. A sailboat may be a monohull boat or a multihulled boat. A multihulled boat may have, in particular, two or three hulls. A multihulled boat may be a catamaran or a trimaran. The sailboat may have one mast or multiple masts. The sailboat may be a sloop. The sailboat may be a schooner, a ketch or a yawl. The sailboat may be a sportsboat. The sailboat may be a raceboat. The sailboat may be a regatta boat. The sailboat may be a touring boat. The profiled sail device may be used as a fore-and-aft sail. The profiled sail device may be used as a mainsail. The profiled sail device may be used as a foresail, a gaff foresail or a spanker sail. The profiled sail device may be an oversize sail. The at least one frame device may have a main plane which is located essentially orthogonally to an axis of the mast. Multiple frame devices having multiple frame elements, which are adjustable in relation to each other and are each intrinsically rigid, may be provided. Multiple frame devices may be adjustable independently of each other. Multiple frame devices may be adjustable together with each other. Multiple frame devices may be synchronously adjustable. Multiple frame devices may be adjustable together with each other but in a proportionally different manner.

A profile is settable independently of an inflow. A set profile may retain its profiling even if the inflow changes. A profile concavity is settable. A profile is invertible. A profile is settable which is optimized for an inflow to the first sail surface. A profile is settable which is optimized for an inflow to the second sail surface. A propulsion force acting upon a mast may be set. A point of origin of a propulsion force acting upon a mast may be set. A torque acting upon a boat hull may be set. The profiled sail device, in particular the at least one frame device, may satisfy the principles of light-weight construction. The profiled sail device, in particular the at least one frame device, has a high rigidity and strength. The profiled sail device may be easily handled.

The at least one frame device may be adjustable between a first operating position, in which the at least one frame device forms a first profile contour for the first sail surface and a first profile contour for the second sail surface, and a second operating position, in which the at least one frame device forms a second profile contour for the first sail surface and a second profile contour for the second sail surface. The first operating position may be a first end position. The second operating position may be a second end position. A further adjustment may be prevented in one end position. A further adjustment may be prevented by the fact that a form fit is provided between the frame elements, which are adjustable in relation to each other. A further adjustment may be prevented by the fact that a stop is provided between the frame elements which are adjustable in relation to each other or by the fact that the frame elements strike each other. The at least one frame device may be adjustable in operating positions which are located between the first operating position and the second operating position. As a result, an appropriate profile surface for the first sail surface and an appropriate profile surface for the second sail surface may be set in the first operating position. An appropriate profile surface for the first sail surface and an appropriate profile surface for the second sail surface may be set in the second operating position. The profile surface for the first sail surface and the profile surface for the second sail surface may be different. The profile surfaces in the first operating position may differ from the profile surfaces in the second operating position.

A first hydrofoil profile may be formed by the first profile contours, and a second hydrofoil profile may be formed by the second profile contours. The first hydrofoil profile may be an asymmetrical hydrofoil profile, and the second hydrofoil profile may be a complementary hydrofoil profile to the first hydrofoil profile. The hydrofoil profile may be a normal profile, whose inflow side (windward side) is convex and whose opposite side (leeward side) is bent in the shape of an S. The hydrofoil profile may be used in a broad speed range. A dynamic propulsion may be generated with the hydrofoil profile.

The at least one frame element may have profile contours which are symmetrical to its longitudinal axis. As a result, the frame device may form a profile contour for the first sail surface in the first operating position and a profile contour for the second sail surface in the second operating position, a change in the operating positions changing the contact surfaces of the frame elements.

The at least one frame element may have spars on the outside, which form the profile contours, and ribs on the inside, which stabilize the spars. The ribs may extend in the direction of main loading directions. The ribs may essentially absorb a pressure load in their longitudinal direction. A light-weight and yet stable structure is achieved thereby. The at least one frame element may include individual rods and/or segments. The at least one frame element may be manufactured as a single piece. The at least one frame element may have a material such as wood, light-weight metal alloys, for example aluminum alloy or titanium alloy, plastics, carbon, fibrous material, such as carbon fibers or glass fibers, and/or particle materials, in particular as fillers for plastic. For example, the at least one frame element may have a filled plastic. For example, the at least one frame element may have carbon fiber-reinforced tubes. The at least one frame element may be a foam sandwich component.

Multiple frame elements may form the first profile contour of the frame device with the aid of their first profile contours in the first operating position and the second profile contour of the frame device with the aid of their second profile contours in the second operating position. The profile contours of the multiple frame elements may form the profile contour of the frame device. The profile contours of the multiple frame elements may fit closely together in a transitional area. A transition between the profile contours of the multiple frame elements may run at least approximately continuously. An even profile surface is achieved thereby.

At least two frame elements may have a shared pivot axis around which they are adjustable relative to each other. The pivot axis may be formed with the aid of a pivot and a hub.

The at least one frame device may have (n) frame elements and (n−1) pivot axes spaced a distance apart. In particular, the frame device may have three frame elements and two pivot axes spaced a distance apart. The at least one frame device may have a first frame element, a second frame element, which is adjustable around a shared first pivot axis with the aid of the first frame element, and a third frame element, which is adjustable around a shared second pivot axis with the aid of the first frame element. The second frame element and the third frame element may have a first profile contour which abuts the first sail surface in the first operating position and a second profile contour which abuts the second sail surface in the second operating position. The first frame element may have a first profile contour which abuts the second sail surface in the first operating position and a second profile contour which abuts the first sail surface in the second operating position.

At least two frame elements may be kinematically coupled in such a way that an adjustment of one frame element causes an adjustment of at least one further frame element. A kinematic coupling of the at least two frame elements may have a first coupling section which is assigned to the one frame element and a second coupling section which corresponds with the first coupling section and which is assigned to the at least one further frame element. The first coupling section and the second coupling section may correspond to each other in a force-fit manner. The kinematic coupling of the at least two frame elements may have a fork-like guide. A first coupling section may have a gap, and a second coupling section may have an extension. The extension may be accommodated in the gap in a motion-transmitting manner. A rolling movement and/or a sliding movement may take place between the first coupling section and the second coupling section when the operating position changes. The first coupling section and the second coupling section may have corresponding involute profiles.

At least one frame element may have an opening for accommodating a mast. The at least one frame element may thus be fastened to the mast. The at least one frame element may be fastened to the mast in a way which limits movement, in particular in a direction orthogonal to a mast axis. The at least one frame element may be pivotable around the mast. The profiled sail device may thus transition from one side to another side, for example during tacking or jibing. The at least one frame element may be movable on the mast in the direction of the mast axis. The profiled sail device may thus be hoisted, lowered or reefed. Multiple, in particular two, frame elements which are located above each other in areas may have openings for accommodating a mast, these openings aligning above each other in such a way that a mast may be accommodated and an adjustment of the profiled sail device is possible.

A holding device having holding elements may be situated between the first sail surface and the second sail surface. The first sail surface and the second sail surface may be connected to each other with the aid of the holding device. The first sail surface and the second sail surface may have a predetermined distance from each other. A preload force may be applied to the first sail surface and/or the second sail surface with the aid of the holding device. The first sail surface and/or the second sail surface may be brought and/or held in contact with a profile contour of a frame device and/or a frame element with the aid of the holding device. The holding elements may have a tube which is used to support the first sail surface and/or the second sail surface and a rope running within the tube which is used to brace the first sail surface and/or the second sail surface.

An adjustment of the at least one frame device may be carried out by actuating the rope, which operates between at least two frame elements. A first rope may be provided, which may be used for adjustment from the first operating position to the second operating position. A second rope may be provided, which may be used for adjustment from the second operating position to the first operating position. The first rope and the second rope may cause an adjustment in the opposite direction. The at least one frame device may be fixed in an operating position by actuating the rope. A rope may be nontractively connected to a frame element. A rope may be relatively movably guided in a frame element.

BRIEF DESCRIPTION OF THE DRAWINGS

Exemplary embodiments of the present invention are described in greater detail below with reference to the figures. Additional features and advantages are derived from this description. Specific features of these exemplary embodiments may represent general features of the present invention. Features of these exemplary embodiments associated with other features may also represent individual features of the present invention.

Schematically and by way of example.

DETAILED DESCRIPTION

Figure 1:
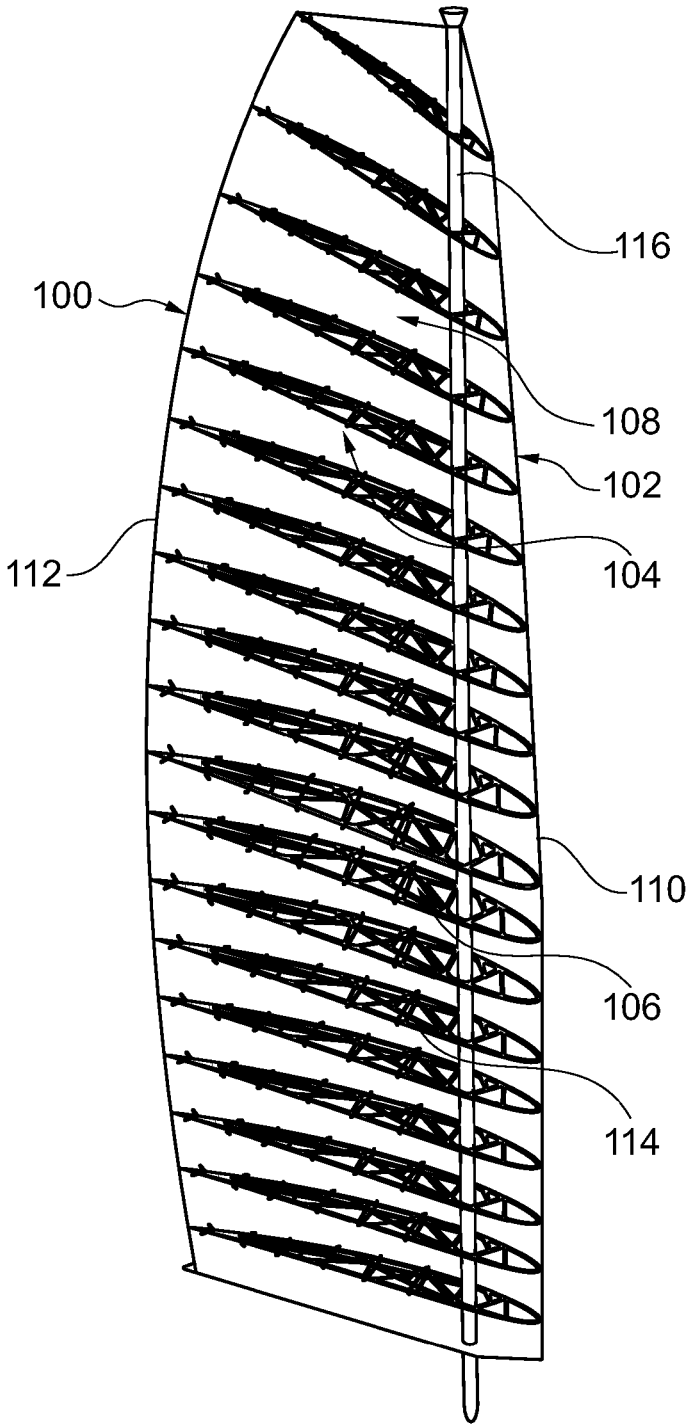
FIG. 1 shows a profiled sail device having externally located sail surfaces and an internal skeleton structure.

FIG. 1 shows a profiled sail device 100 having externally located sail surfaces 102, 104 and an internal skeleton structure 106. Profiled sail device 100 is used to drive a sailing craft, which is not illustrated in greater detail herein. Skeleton structure 106 specifies the shape of profiled sail device 100. Sail surfaces 102, 104 are stretched over skeleton structure 106. Profiled sail device 100 has a first sail surface 102 and an opposite second sail surface 104. A cavity 108 is formed between sail surfaces 102, 104, in which skeleton structure 106 is situated.

Profiled sail device 100 has a hydrofoil profile, which may be used to generate a dynamic propulsion with the aid of a hydrofoil effect. The hydrofoil profile of profiled sail device 100 is adjustable. A first operating position may be set for an inflow to first sail surface 102, and a second operating position may be set for an inflow to second sail surface 104. The inflow sail surface has a convex curved surface. The opposite sail surface has a surface which is bent into an S shape. Profiled sail device 100 has a profile leading edge 110 having a leading edge radius and a profile trailing edge 112 having a trailing edge angle. The longest line from profile leading edge 110 to profile trailing edge 112, which is identical to the profile chord, determines the profile depth. The profile concavity is derived as the greatest possible deviation of the skeleton line from the profile chord. The line which is located precisely between sail surfaces 102, 104 in the cross section of profiled sail device 100 is referred to as the skeleton line. The profile contour of profiled sail device 100 is thus symmetrical around its skeleton line. Another definition is: The skeleton line is the connecting line of circular midpoints in a profile. The profile thickness is the greatest possible circular diameter on the skeleton line within the profile. The profile concavity primarily determines the maximum propulsion and is essential for a torque coefficient.

Sail surfaces 102, 104 may include a woven cloth made of plastic fibers. Sail surfaces 102, 104 may be formed by a laminate sail, in which fibers are glued to films or a fabric. Sail surfaces 102, 104 may be formed by a membrane sail, in which reinforcing fibers are already introduced during manufacture of the sail according to a load line to be expected. Sail surfaces 102, 104 may have plastic fibers, for example made of polyamide, polyester, polyethelenenaphthalate, aramide and/or carbon fibers.

Skeleton structure 106 has multiple frame devices, 19 in the present case, as in the case of 114. Frame devices 114 each have three frame elements which are adjustable in relation to each other. As a result, profiled sail device 100 may be adjusted in such a way that first sail surface 102 forms the leading side of the hydrofoil in the first operating position, and second sail surface 104 forms a trailing side, and second sail surface 104 forms the leading side of the hydrofoil in the second operating position, and first sail surface 102 forms a trailing side.

Profiled sail device 100 is situated on a mast 116. Mast 116 extends into cavity 108 and through openings in frame devices 114 when profiled sail device 100 is hoisted. A clearance is present between edges of the openings and the mast. Frame devices 114 are displaceable on mast 116 to a limited degree. Frame devices 114 are movable on mast 116 in the direction of the mast axis. Frame devices 114 are pivotable around mast 116. As a result, profiled sail device 100 is pivotable around mast 116. Mast 116 runs in the hydrofoil profile behind profile leading edge 110, so that a smaller section of profiled sail device 100 extends between mast 116 and profile leading edge 110, and a larger section of profiled sail device 100 extends between mast 116 and profile trailing edge 112. In the present case, mast 116 is fixedly, in particular rotatably fixedly, connected to a craft body such as a boat hull. Mast 116 may stand on a keel and be guided through a deck. Alternatively, mast 116 may stand on the deck and be supported on a keel from below.

Figure 2:
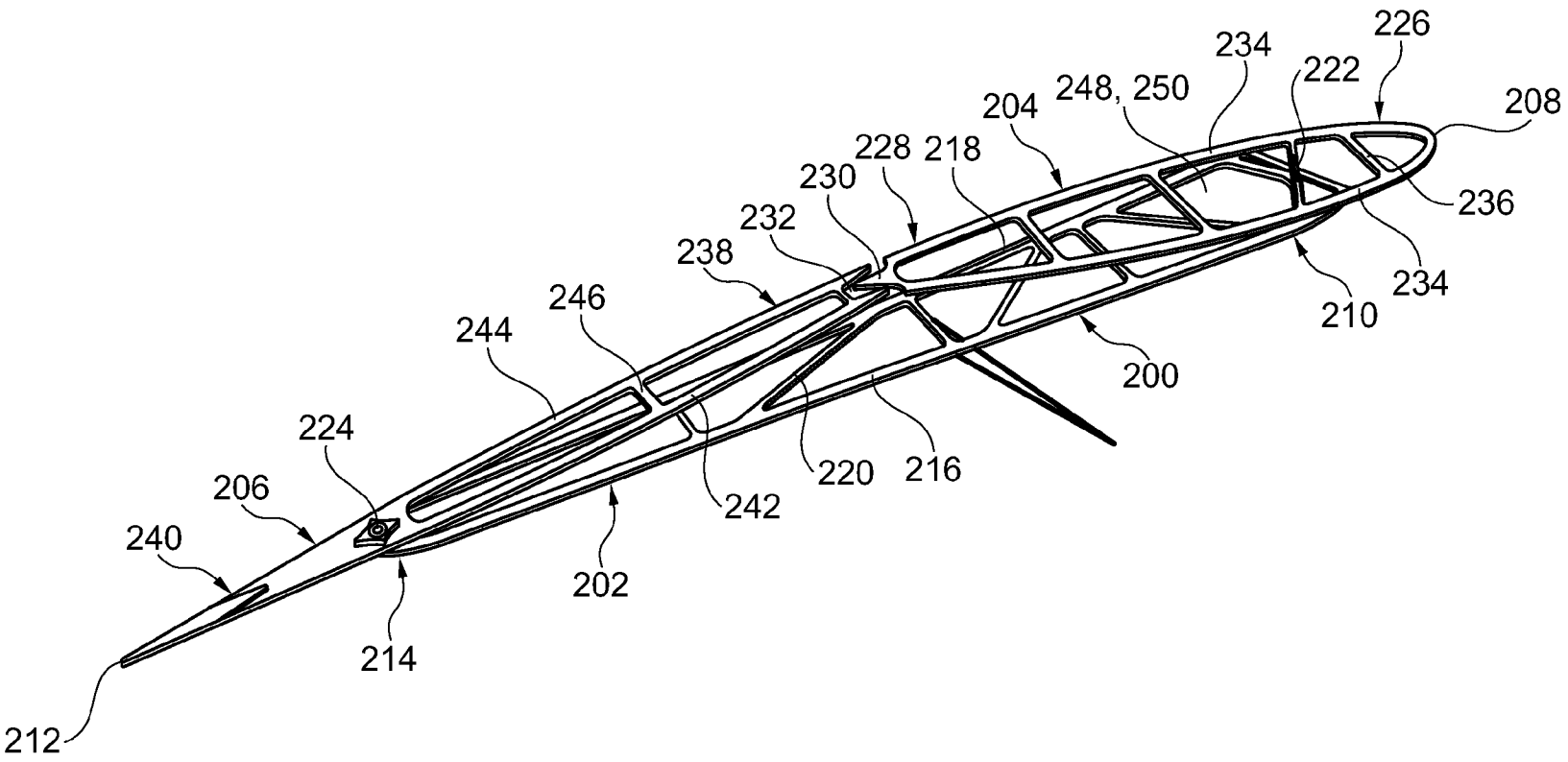
FIG. 2 shows a frame device having three frame elements.

FIG. 2 shows a frame device 200 of a profiled sail device, such as frame device 114 of a profiled sail device 100 according to FIG. 1, which has three frame elements 202, 204, 206. One frame element 202 is a central frame element. One frame element 204 forms a profile leading edge section of frame device 200 and thus of the hydrofoil profile. One frame element 206 forms a profile trailing edge section of frame device 200 and thus of the hydrofoil profile.

Frame element 202 has a greater width on its end 210 facing profile leading edge 208 of the hydrofoil profile than on its end 214 facing profile trailing edge 212. Frame element 202 becomes steadily narrower as it runs from its end 210 to its end 214. Frame element 202 has lateral spars 216, 218, which form a profile contour. Spars 216, 218 are stabilized by ribs 220. Frame element 202 has an articulated joint 222 in the area of its end 210 for articulated connection to frame element 204. Frame element 202 has an articulated joint 224 in the area of its end 214 for articulated connection to frame element 206. Frame element 202 has a main extension plane, on which spars 216, 218 and ribs 220 extend. Articulated joints 222, 224 have axes which are orthogonally oriented toward the main extension plane. Openings and/or pivots are provided on frame element 202 for forming articulated joints 222, 224.

Frame element 204 has a droplet-like outer contour. One end 226 of frame element 204 forms profile leading edge 208 of frame device 200 and thus of the hydrofoil profile. One end 228 of frame element 204 facing profile trailing edge 212 has a coupling section 230. Coupling section 230 is used for kinematic coupling with frame element 206 in such a way that an adjustment of frame element 204 relative to frame element 202 also causes an adjustment of frame element 206. In the present case, coupling section 230 has an extension which engages with a corresponding recess of a coupling section 232 of frame element 206. In its extension from its end 226 to its end 228, frame element 204 initially widens as a bulge and then tapers to a point. Frame element 204 has a circumferential spar 234, which forms a profile contour. Spar 234 is stabilized by ribs 236. Frame element 204 has an articulated joint 222 for articulated connection to frame element 202. Frame element 204 has a main extension plane, on which spar 234 and ribs 236 extend. The axis of articulated joint 222 is orthogonally oriented toward the main extension plane. An opening or a pivot is provided on frame element 204 for forming articulated joint 222.

Frame element 206 has a needle-like shape. One end 238 of frame element 206 facing profile leading edge 208 has a coupling section 232. Coupling section 232 is used for kinematic coupling with frame element 204 in such a way that an adjustment of frame element 206 relative to frame element 202 also causes an adjustment of frame element 204. In the present case, coupling section 232 has a recess which engages with a corresponding extension of coupling section 230 of frame element 204. One end 240 of frame element 206 forms profile trailing edge 212 of frame device 200 and thus of the hydrofoil profile. Frame element 206 tapers to a point from its end 238 to its end 240. Frame element 206 has lateral spars 242, 244, which form a profile contour. Spars 242, 244 are stabilized by ribs 246. Frame element 206 has an articulated joint 224 for articulated connection to frame element 202. Frame element 206 has a main extension plane, on which spars 242, 244 and ribs 236 extend. The axis of articulated joint 222 is orthogonally oriented toward the main extension plane. An opening or a pivot is provided on frame element 206 for forming articulated joint 222.

Frame elements 202, 204, 206 form a profile contour of frame device 200 with the aid of their profile contours. A transition from one profile contour of one frame element to a profile contour of another frame element runs continuously in such a way that the sail surfaces at least approximately evenly abut the profile contour. In the present case, the spars of frame elements 202, 204, 206 have a rectangular cross-sectional surface having an edge length of approximately 20 mm to 40 mm, in particular approximately 30 mm, x approximately 10 mm to 30 mm, in particular approximately 20 mm. The ribs of frame elements 202, 204, 206 have a smaller cross-sectional surface. Transitions between spars and ribs and between ribs are provided with a rounded design having radii in the present case. This results in a more favorable force development. Stress peaks are avoided. A load tolerance is improved.

Frame element 202 has an opening 248. Frame element 204 has an opening 250. A mast may be accommodated in openings 248, 250. Frame device 200 may be fastened to a mast with the aid of openings 248, 250. The mast is accommodated with clearance in openings 248, 250. The displaceability of frame device 200 relative to the mast is thus limited. Frame device 200 is thus pivotable around the mast. Openings 248, 250 overlap each other in such a way that a movability of frame device 200 relative to the mast is retained even if frame device 200 is adjusted, in particular if frame elements 202, 204 are adjusted to each other.

Figure 3A:
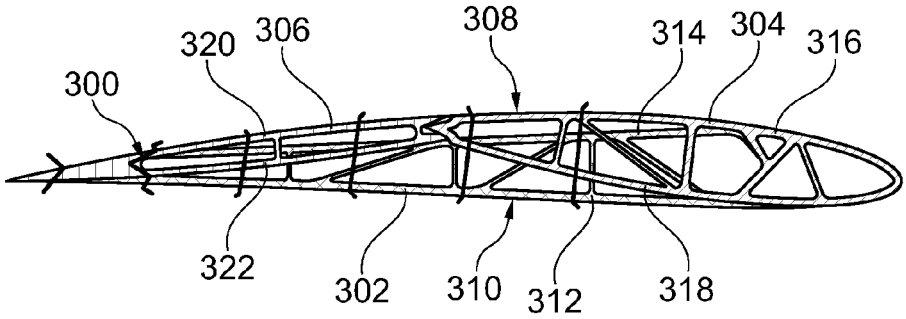
FIG. 3*a* shows a frame device having three frame elements and sail surfaces in a first operating position.
Figure 3B:
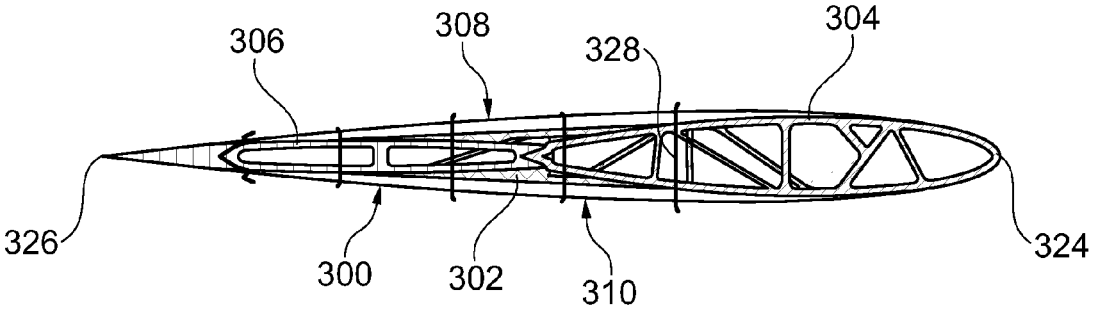
FIG. 3*b* shows a frame device having three frame elements and sail surfaces in a second operating position.
Figure 3C:
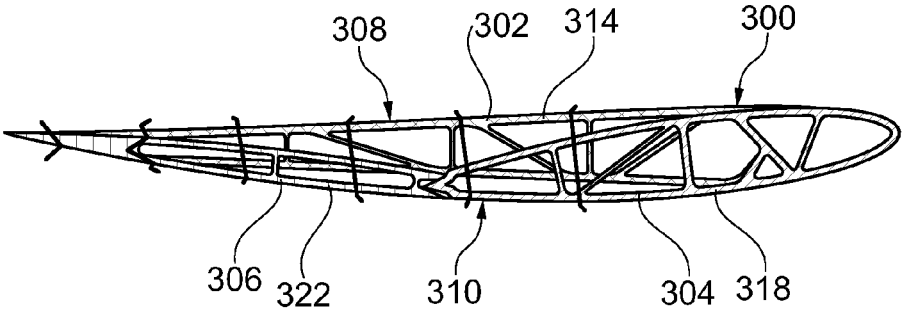
FIG. 3*c* shows a frame device having three frame elements and sail surfaces in a neutral middle position.

FIG. 3*a* shows a frame device 300 of a profiled sail device, such as frame device 114 of a profiled sail device 100 according to FIG. 1, which has three frame elements 302, 304, 306 and sail surfaces 308, 310 in a first operating position. A second operating position of frame device 300 is illustrated in FIG. 3*b*. FIG. 3*c* shows frame device 300 in a neutral middle position between the first operating position and the second operating position.

In the first operating position illustrated in FIG. 3*a*, frame device 300 forms a hydrofoil profile, in which sail surface 308 forms an inflow leading edge and sail surface 310 forms a trailing edge. During operation of a sailing craft, sail surface 308 is usually located on the windward side and sail surface 310 is located on the leeward side. Frame element 302 has a profile contour 312, which is assigned to sail surface 310, and a profile contour 314, which is assigned to sail surface 308. Frame element 304 has a profile contour 316, which is assigned to sail surface 308, and a profile contour 318, which is assigned to sail surface 310. Frame element 306 has a profile contour 320, which is assigned to sail surface 308, and a profile contour 322, which is assigned to sail surface 310. In the first operating position, profile contour 316 of frame element 304 and profile contour 320 of frame element 306 form a profile contour of frame device 300 for sail surface 308. In the first operating position, profile contour 312 of frame element 302 forms a profile contour of frame device 300 for sail surface 310. Sail surfaces 308, 310 circumferentially abut the profile contour of frame device 300.

In the second operating position illustrated in FIG. 3*c*, frame device 300 forms a hydrofoil profile, in which sail surface 310 forms an inflow leading edge and sail surface 308 forms a trailing edge. During operation of a sailing craft, sail surface 310 is usually located on the windward side and sail surface 308 is located on the leeward side. In the first operating position, profile contour 318 of frame element 304 and profile contour 322 of frame element 306 form a profile contour of frame device 300 for sail surface 310. In the first operating position, profile contour 314 of frame element 302 forms a profile contour of frame device 300 for sail surface 308. Sail surfaces 308, 310 circumferentially abut the profile contour of frame device 300.

In the neutral middle position shown in FIG. 3*b*, frame device 300 forms a symmetrical profile contour. Sail surfaces 308, 310 do not circumferentially abut the profile contour of frame device 300 in this middle position. In particular, in a middle section located between profile leading edge 324 and profile trailing edge 326, sail surfaces 308, 310 do not abut the profile contour of frame device 300. On profile leading edge 324 and on profile trailing edge 326, sail surfaces 308, 310 abut the profile contour of frame device 300 even in the middle position.

It is apparent from FIG. 3*b* that sail surfaces 308, 310 are located a defined distance from each other. This is achieved with the aid of a holding device for sail surfaces 308, 310 which has multiple holding elements, such as 328. Holding elements 328 each have a rope piece and a tube piece. The tube piece is located on the inside of sail surfaces 308, 310 and defines a distance between sail surfaces 308, 310 corresponding to its length. The rope piece is guided within the tube piece and is connected tension-proof to both sail surface 308 and sail surface 310. Holding elements located closer to profile leading edge 324 are longer than holding elements located closer to profile trailing edge 326. The holding elements extend approximately orthogonally to sail surfaces 308, 310.

Figure 4:
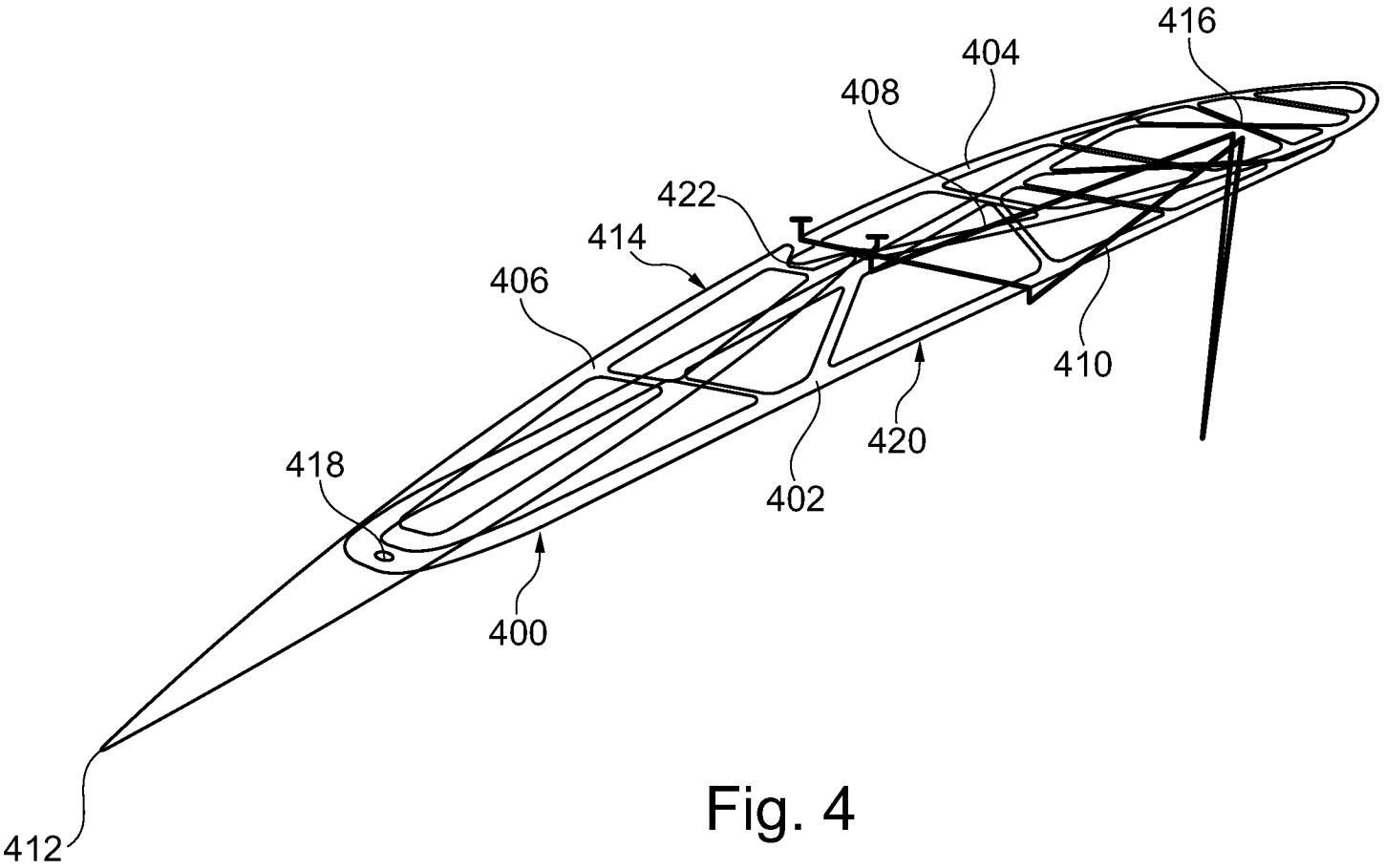
FIG. 4 shows an isometric view of a frame device including rope actuation.

FIG. 4 shows an isometric view of a frame device 400 of a profiled sail device, such as frame device 114 of a profiled sail device 100 according to FIG. 1, including rope actuation. Frame device 400 has three frame elements 402, 404, 406. The rope actuation system has two ropes 408, 410. Rope 408 is connected tension-proof to frame element 404 in an end area facing profile trailing edge 412 and in a side area facing profile contour 414, and it is initially guided on an upper or lower side of frame device 400 transversely to a longitudinal axis of frame device 400 and transversely to pivot axes 416, 418. On another course, rope 408 is guided through a rope guide in frame element 402 to the side of frame device 400 opposite the upper or lower side. On another course, rope 408 is guided to a mast, which is not illustrated in FIG. 4, and along this mast in the direction of a mast base. Rope 410 is connected tension-proof to frame element 404 in an end area facing profile trailing edge 412 and in a side area facing profile contour 420, and it is initially guided on an upper or lower side of frame device 400 transversely to a longitudinal axis of frame device 400 and transversely to pivot axes 416, 418. On another course, rope 410 is guided through a rope guide in frame element 402 to the side of frame device 400 opposite the upper or lower side. On another course, rope 408 is guided to the mast and along this mast in the direction of a mast base.

Frame device 400 is adjustable between the first operating position and the second operating position with the aid of ropes 408, 410. A pulling actuation of rope 408 causes frame device 400 to be adjusted to the first operating position. The end of rope 408 which is fastened tension-proof to frame element 404 is pulled in the direction of the rope guide in frame element 402 until the fastening point of rope 408 is located on frame element 404 approximately above the rope guide in frame element 402. At the same time, frame element 406 is entrained with the aid of kinematic coupling 422 between frame element 404 and frame element 406. Frame elements 404, 406 pivot in opposite directions. Frame device 400 may be fixed in the first operating position with the aid of rope 408. A pulling actuation of rope 410 causes frame device 400 to be adjusted to the second operating position. The end of rope 410 which is fastened tension-proof to frame element 404 is pulled in the direction of the rope guide in frame element 402 until the fastening point of rope 410 is located on frame element 404 approximately above the rope guide in frame element 402. At the same time, frame element 406 is entrained with the aid of kinematic coupling 422 between frame element 404 and frame element 406. Frame elements 404, 406 pivot in opposite directions. Frame device 400 may be fixed in the second operating position with the aid of rope 410. In another application, ropes of the rope actuating system may be alternatively or additionally connected tension-proof to frame element 406, so that a pulling actuation initially causes an adjustment of frame element 406. In another application, actuating rods may be alternatively or additionally used. A pulling actuation or a pushing actuation may take place with the aid of the actuating rods.

Figure 5:
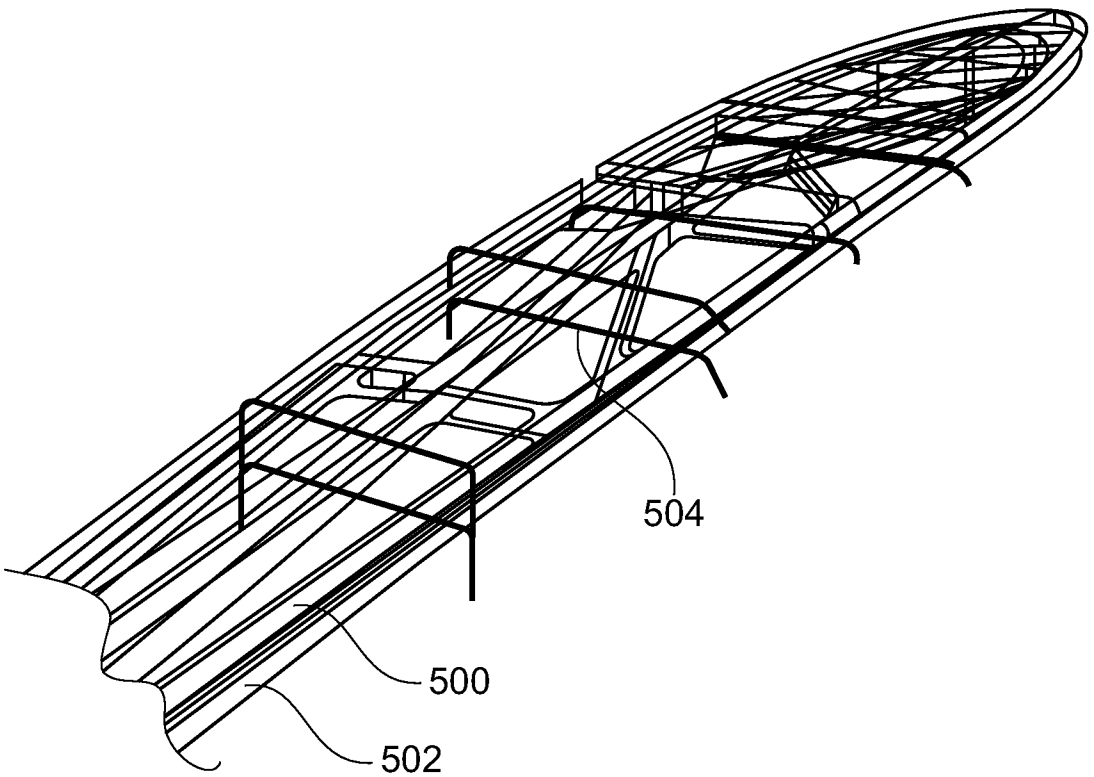
FIG. 5 shows frame devices of a profiled sail device in the folded-up state.

FIG. 5 shows a frame device 500, 502 of a profiled sail device, such as frame device 114 of a profiled sail device 100 according to FIG. 1, in the folded-up state in which the profiled sail device is secured. The sail surfaces may be detached from frame devices 500, 502 and removed. Frame devices 500 may be stacked above each other. As is apparent in FIG. 5, the holding elements, such as 504, are situated on frame devices 500, 502.

Figure 6A:
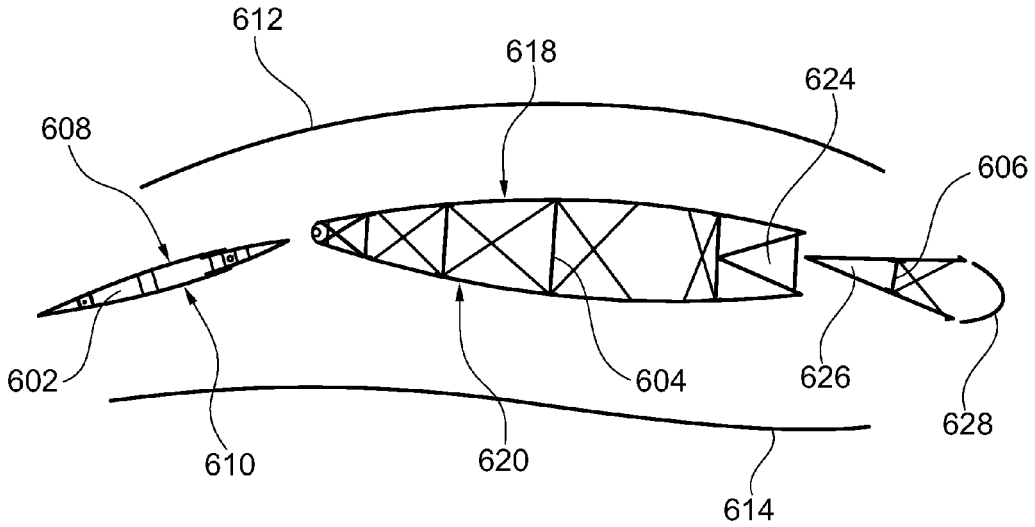
FIG. 6*a* shows a frame device having three frame elements in an exploded view.
Figure 6B:
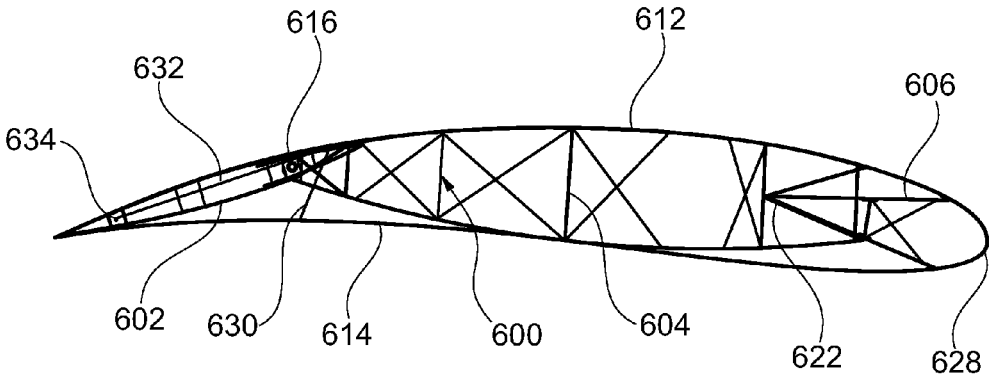
FIG. 6*b* shows a frame device having three frame elements in the assembled state.

FIG. 6*a* shows an exploded view of a frame device 600 of a profiled sail device having three frame elements 602, 604, 606; FIG. 6*b* shows frame device 600 in the assembled state. Frame device 600 is an alternative design of frame devices 114, 200, 300, 400, 500 according to FIGS. 1 through 5. Frame device 602 is assigned to a trailing edge of the profiled sail device. Frame element 606 is assigned to a leading edge of the profiled sail device. Frame element 604 is situated between frame element 602 and frame element 606.

Frame element 602 has an end which tapers to a point. Frame element 602 has two profile contours 608, 610 located opposite each other. Profile contour 608 is assigned to a sail surface 612. Profile contour 610 is assigned to a sail surface 614. Frame element 602 is adjustably connected to frame element 604. Frame element 602 and frame element 604 are pivotable relative to each other around an axis 616. Frame element 604 has two profile contours 618, 620 located opposite each other. Profile contour 618 is assigned to sail surface 612. Profile contour 620 is assigned to sail surface 614. Frame element 604 is adjustably connected to frame element 606. Frame element 604 is connected to frame element 606 with the aid of a hinge-like joint 622. The joint has a joint axis. Frame element 604 has a fork-like joint socket 624 of joint 622 on one end. Frame element 606 has a tooth-like joint head 626 of joint 622 on one end. Joint socket 624 has a widened opening angle in relation to joint head 626. Frame element 604 and frame element 606 are adjustable in relation to each other between a first end position and a second end position. A stop is provided in each end position with the aid of joint 622. The other end of frame element 606 is assigned to leading edge 628 of the profiled sail device.

In an end position or operating position, as illustrated in FIG. 6*b*, entire profile contour 608 of frame element 602 and entire profile contour 618 of frame element 604 form a section of a profile contour of frame device 600. Sail surface 612 abuts entire profile contour 608 of frame element 602 and entire profile contour 618 of frame element 604. A limited section of profile contour 620 of frame element 604 forms a section of a profile contour of frame device 600. Sail surface 614 abuts the limited section of profile contour 620 of frame element 604. Frame element 606 is adjusted in relation to sail surface 614. Sail surface 614 is situated at a distance from frame device 600 in sections. A spacer 630 is used to hold sail surface 614 in a section spaced a distance from frame device 600 in a defined manner. A tensioning rope 632 is guided around an axis 634 on frame element 602.

In another end position or operating position not illustrated herein, entire profile contour 610 of frame element 602 and entire profile contour 620 of frame element 604 form a section of a profile contour of frame device 600. Sail surface 614 abuts entire profile contour 610 of frame element 602 and entire profile contour 620 of frame element 604. A limited section of profile contour 618 of frame element 604 forms a section of a profile contour of frame device 600. Sail surface 612 abuts the limited section of profile contour 618 of frame element 604. Frame element 606 is adjusted in relation to sail surface 612. Sail surface 612 is situated at a distance from frame device 600 in sections. A spacer 630 is used to hold sail surface 612 in a section spaced a distance from frame device 600 in a defined manner. Moreover, reference is hereby additionally made, in particular, to FIGS. 1 through 5 and to the associated description.

LIST OF REFERENCE NUMERALS

100 Profiled sail device
102 Sail surface
104 Sail surface
106 Skeleton structure
108 Cavity
110 Profile leading edge
112 Profile trailing edge
114 Frame device
116 Mast
200 Frame device
202 Frame element
204 Frame element
206 Frame element
208 Profile leading edge
210 End
212 Profile trailing edge
214 End
216 Spar
218 Spar
220 Ribs
222 Articulated joint
224 Articulated joint
226 End
228 End
230 Coupling section
232 Coupling section
234 Spar
236 Ribs
238 End
240 End
242 Spar
244 Spar
246 Ribs
248 Opening
250 Opening
300 Frame device
302 Frame element
304 Frame element
306 Frame element
308 Sail surface
310 Sail surface
312 Profile contour
314 Profile contour
316 Profile contour
318 Profile contour
320 Profile contour
322 Profile contour
324 Profile leading edge
326 Profile trailing edge
328 Holding element
400 Frame device
402 Frame element
404 Frame element
406 Frame element
408 Rope
410 Rope
412 Profile trailing edge
414 Profile contour
416 Pivot axis
418 Pivot axis
420 Profile contour
422 Coupling
500 Frame device
502 Frame device
504 Holding element
600 Frame device
602 Frame element
604 Frame element
606 Frame element
608 Profile contour
610 Profile contour
612 Sail surface
614 Sail surface
616 Axis
618 Profile contour
620 Profile contour

622 Joint
624 Joint socket
626 Joint head
628 Leading edge
630 Spacer
632 Tensioning rope
634 Axis

What is claimed is:

1. A frame device for a profiled sail device, the frame device comprising:

a plurality of frame elements adjustable in relation to each other, at least one frame element having a first profile contour assigned to one sail surface, and a second profile contour assigned to another sail surface, the frame device having a profile contour including at least one profile contour section formed with the aid of the first or second profile contour of the at least one frame element, and the frame device being adjustable between a first operating position and a second operating position, in the first operating position, the first profile contour of the at least one frame element forming at least one profile contour section of the frame device for the first sail surface or for the second sail surface, and the second profile contour of the at least one frame element not forming a profile contour section of the frame device for the sail surface; and, in the second operating position, the first profile contour of the at least one frame element not forming a profile contour section of the frame device for the sail surface, and the second profile contour of the at least one frame element forming at least one profile contour section of the frame device for the other sail surface.

2. The frame device as recited in claim 1 wherein the frame elements include a first frame element, a second frame element and a third frame element, each adjustable in relation to each other, the second frame element being situated between the first frame element and the third frame element, the first frame element having a first profile contour assigned to the first sail surface and a second profile contour assigned to the second sail surface, the second frame element having a first profile contour assigned to the second sail surface and a second profile contour assigned to the first sail surface, the third frame element having a first profile contour assigned to the first sail surface and a second profile contour assigned to the second sail surface, in the first operating position, the first profile contour of the first frame element forming a profile contour section of the frame device for the first sail surface, and the second profile contour of the first frame element not forming a profile contour section of the frame device for the sail surface, the first profile contour of the second frame element forming a profile contour section of the frame device for the second sail surface, and the second profile contour of the second frame element not forming a profile contour section of the frame device for the sail surface, and the first profile contour of the third frame element forming a profile contour section of the frame device for the first sail surface, and the second profile contour of the third frame element not forming a profile contour section of the frame device for the sail surface and, in the second operating position, the first profile contour of the first frame element not forming a profile contour section of the frame device for the sail surface, and the second profile contour of the first frame element forming a profile contour section of the frame device for the second sail surface, the first profile contour of the second frame element forming a profile contour section of the frame device for the second sail surface, and the second profile contour of the second frame element not forming a profile contour section of the frame device for the sail surface, and the first profile contour of the third frame element not forming a profile contour section of the frame device for the sail surface, and the second profile contour of the third frame element forming a profile contour section of the frame device for the second sail surface.

3. The frame device as recited in claim 1 wherein the frame elements include a first frame element, a second frame element and a third frame element, each adjustable in relation to each other, the second frame element being situated between the first frame element and the third frame element, the first frame element having a first profile contour assigned to the first sail surface and a second profile contour assigned to the second sail surface, the second frame element having a first profile contour assigned to the first sail surface and a second profile contour assigned to the second sail surface, the third frame element having a profile contour which is assigned to a sail leading edge, in the first operating position, the first profile contour of the first frame element forming a profile contour section of the frame device for the first sail surface, and the second profile contour of the first frame element not forming a profile contour section of the frame device for the sail surface, one section of the second profile contour of the second frame element forming a profile contour section of the frame device for the second sail surface, and at least approximately the entire first profile contour of the second frame element forming a profile contour section of the frame device for the first sail surface, and the profile contour of the third frame element forming a profile contour section of the frame device assigned to the sail leading edge and, in the second operating position, the first profile contour of the first frame element not forming a profile contour section of the frame device for the sail surface, and the second profile contour of the first frame element forming a profile contour section of the frame device for the second sail surface, one section of the first profile contour of the second frame element forming a profile contour section of the frame device for the first sail surface, and at least approximately the entire second profile contour of the second frame element forming a profile contour section of the frame device for the second sail surface, and the profile contour of the third frame element forming a profile contour section of the frame device assigned to the sail leading edge.

4. The frame device as recited in claim 1 wherein one of the frame elements and another frame element are adjustably connected to each other with the aid of a hinged joint.

5. The frame device as recited in claim 4 wherein the one frame element has a forked joint socket and the other frame element has a tooth joint head.

6. The frame device as recited in claim 4 wherein the joint has a first stop for limiting an adjustability in the first operating position and a second stop for limiting an adjustability in the second operating position.

7. The frame device as recited in claim 1 wherein at least two of the frame elements are adjustable in relation to each other and are kinematically coupled in such a way that adjustment of one of the two frame elements causes adjustment of the other of the two frame elements.

8. The frame device as recited in claim 7 wherein the one frame element has a first coupling section having a gap for kinematic coupling with another frame element, and the other frame element has a second coupling section having an extension.

9. The frame device as recited in claim 1 wherein the frame elements include a first frame element, a second frame element and a third frame element, each adjustable in relation to each other, the second frame element being situated between the first frame element and the third frame element, and the first frame element being kinematically coupled with the third frame element in such a way that adjustment of the first frame element or the third frame element causes adjustment of the other of the first or third frame elements.

10. A profiled sail device comprising:

a first inflow sail surface forming a first profile surface;

a second inflow sail surface forming a second profile surface; and a leading edge and an adjustable skeleton structure situated between the first sail surface and the second sail surface, the skeleton structure having at least one frame device as recited in claim 1.

11. A profiled sail device comprising:

a first inflow sail surface forming a first profile surface;

a second inflow sail surface forming a second profile surface; and a leading edge and an adjustable skeleton structure situated between the first sail surface and the second sail surface, the skeleton structure having at least two frame device as recited in claim 1 wherein the plurality of frame devices are skewed in relation to each other.

12. A profiled sail device comprising:

a first inflow sail surface forming a first profile surface and a second inflow sail surface forming a second profile surface; and an adjustable skeleton device situated between the first sail surface and the second sail surface, the skeleton device including a plurality of frame devices, at least one frame device having multiple frame elements adjustable in relation to each other and each being intrinsically rigid, at least one of the frame elements having a first profile contour abutting the first sail surface in the first operating position and a second profile contour abutting the second sail surface in the second operating position, and/or at least one other of the frame elements having a first other profile contour abutting the second sail surface in the first operating position and a second other profile contour abutting the first sail surface in the second operating position.

13. A profiled sail device as recited in claim 12 wherein the plurality of frame devices are skewed in relation to each other.

14. A profiled sail device as recited in claim 12 wherein the first profile contour and second profile contour are settable independently of an inflow.

15. A profiled sail device as recited in claim 12 wherein the first profile contour and second profile contour may retain their profiling even if an inflow changes.

* * * * *